US009862201B2

(12) United States Patent
Ando

(10) Patent No.: US 9,862,201 B2
(45) Date of Patent: Jan. 9, 2018

(54) PRINTING APPARATUS

(71) Applicant: SEIKO EPSON CORPORATION, Tokyo (JP)

(72) Inventor: Masaaki Ando, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/055,700

(22) Filed: Feb. 29, 2016

(65) Prior Publication Data

US 2016/0288525 A1 Oct. 6, 2016

(30) Foreign Application Priority Data

Mar. 30, 2015 (JP) ..... 2015-068977

(51) Int. Cl.
*B41J 2/19* (2006.01)
*B41J 2/175* (2006.01)
*B41J 2/18* (2006.01)

(52) U.S. Cl.
CPC ..... *B41J 2/19* (2013.01); *B41J 2/175* (2013.01); *B41J 2/18* (2013.01)

(58) Field of Classification Search
CPC .... B41J 2/175; B41J 2/17513; B41J 2/17566; B41J 2/17523; B41J 2/18; B41J 2/19
USPC ..... 347/6, 84, 85, 92
See application file for complete search history.

(56) References Cited

U.S. PATENT DOCUMENTS

2009/0295889 A1* 12/2009 Anno ..... B41J 2/175 347/89
2012/0212550 A1 8/2012 Hori et al.

FOREIGN PATENT DOCUMENTS

JP 2012-171181 A 9/2012

* cited by examiner

*Primary Examiner* — Jannelle M Lebron
(74) *Attorney, Agent, or Firm* — Global IP Couselors, LLP

(57) ABSTRACT

A printing apparatus includes: an ink discharge head that discharges UV ink; a sub-tank that stores the UV ink; a forward circulation path through which the UV ink flowing out from the sub-tank to the ink discharge head flows; an inflow path through which the UV ink flowing into the sub-tank flows; and a receptacle that is provided inside the sub-tank and blocks bubbles contained in the UV ink flowing into the sub-tank from the inflow path, from entering the forward circulation path.

4 Claims, 4 Drawing Sheets

PRINTING APPARATUS

BACKGROUND

1. Technical Field

The present invention relates to a printing apparatus that includes an ink storage unit that stores ink.

2. Related Art

Recently, an ink jet printer that includes a print head which discharges ink, a sub-tank that stores ink, a forward path through which ink flowing out from the sub-tank to the print head flows, and a backward path through which ink flowing into the sub-tank flows has been known (refer to JP-A-2012-171181).

The inventors have found the following problems.

In a printing apparatus such as an ink jet printer in the related art, in a case where bubbles are contained in the ink flowing from an inflow path to the ink storage unit, there is a concern that the bubbles will enter the outflow path. When the bubbles entering the outflow path reaches an ink discharge head, this results in a defective discharge of the ink discharge head and the absence of dots on a printed image occurs.

SUMMARY

An advantage of some aspects of the invention is to provide a printing apparatus in which it is possible to prevent the occurrence of the absence of dots on a printed image.

According to an aspect of the invention, there is provided a printing apparatus including: an ink discharge head that discharges ink; an ink storage unit that stores the ink; an outflow path through which the ink flowing out from the ink storage unit to the ink discharge head flows; an inflow path through which the ink flowing into the ink storage unit flows; and a bubble blocking unit that is provided inside the ink storage unit and blocks bubbles contained in the ink flowing into the ink storage unit from the inflow path, from entering the outflow path.

In this case, although bubbles are contained in the ink flowing into the ink storage unit from the inflow path, the bubble blocking unit blocks the bubbles from entering the outflow path. As a result, it is unlikely that the bubbles reach the ink discharge head, and thus it is possible to reduce the occurrence of defective discharge of the ink discharge head due to the bubbles. Accordingly, in the printing apparatus, it is possible to prevent the occurrence of the absence of dots on the printed image.

According to another aspect of the invention, there is provided a printing apparatus including: an ink discharge head that discharges ink; an ink storage unit that stores the ink; an outflow path through which the ink flowing out from the ink storage unit to the ink discharge head flows; an inflow path through which the ink flowing into the ink storage unit flows; and a receptacle that has an opening which opens upward and that is provided such that an opening edge portion of the opening surrounds an inlet of the inflow path, in a top view, in which an outlet of the outflow path is positioned below the inlet, and the opening of the receptacle is positioned above a virtual line connecting the inlet and the outlet of the outflow path.

In this case, although the bubbles are contained in the ink flowing into the ink storage unit from the inflow path and the bubbles move from the inlet to the outlet, the movement is blocked at a position along the path by the receptacle and the bubbles rise toward the liquid surface due to their buoyancy. Therefore, the bubbles are prevented from entering the outflow path from the outlet provided below the inlet. As a result, it is unlikely that the bubbles reach the ink discharge head, and thus it is possible to reduce the occurrence of defective discharge of the ink discharge head due to the bubbles. Accordingly, in the printing apparatus, it is possible to prevent the occurrence of the absence of dots the printed image.

In the printing apparatus, it is preferable that the opening of the receptacle is positioned above the inlet.

In this case, the movement of the bubbles to the outlet from the inlet is blocked by the receptacle. Therefore, the bubbles are further effectively prevented from entering the outflow path.

In the printing apparatus, it is preferable that the apparatus further includes a plurality of the inflow paths, in which the single receptacle is provided with respect to the plurality of inflow paths.

In this case, although the plurality of receptacles are not provided in one-to-one correspondence to the plurality of inflow paths, the bubbles flowing into the ink storage unit from the respective inflow paths are prevented from entering the outflow path. Therefore, according to the configuration, it is possible to reduce the number of receptacles, compared to a case where the plurality of receptacles are provided in one-to-one correspondence to the plurality of inflow paths.

In the printing apparatus, it is preferable that a plurality of the inflow paths; and a plurality of the receptacles are further included, in which the plurality of receptacles are provided in one-to-one correspondence to the plurality of inflow paths.

In this case, even in a case where the outlets of the outflow paths are provided between the respective inlets of the plurality of inflow paths, the bubbles flowing into the ink storage unit from the respective inflow paths are prevented from entering the outflow path.

According to still another aspect of the invention, there is provided a printing apparatus including: an ink discharge head that discharges ink; an ink storage unit that stores the ink; an outflow path through which the ink flowing out from the ink storage unit to the ink discharge head flows; an inflow path through which the ink flowing into the ink storage unit flows; and a partition wall that is provided between the inlet of the inflow path and an outlet of the outflow path, in which the outlet of the outflow path is positioned below the inlet, and an upper end portion of the partition wall is positioned above a virtual line connecting the inlet and the outlet.

In this case, although the bubbles are contained in the ink flowing into the ink storage unit from the inflow path and the bubbles move from the inlet to the outlet, the movement is blocked at a position along the path by the partition wall and the bubbles rise toward the liquid surface due to their buoyancy. Therefore, the bubbles are prevented from entering the outflow path from the outlet provided below the inlet is suppressed. As a result, it is unlikely that the bubbles reach the ink discharge head, and thus it is possible to reduce the occurrence of defective discharge of the ink discharge head due to the bubbles. Accordingly, in the printing apparatus, it is possible to prevent the occurrence of the absence of dots on the printed image.

In the printing apparatus, it is preferable that the upper end portion of the partition wall is positioned above the inlet.

In this case, the movement of the bubbles to the outlet from the inlet is likely to be blocked by the partition wall. Therefore, the bubbles are further effectively prevented from entering the outflow path.

In the printing apparatus, it is preferable that the inflow path has a backward circulation path through which the ink, which returns to the ink storage unit from the ink discharge head, flows.

In this case, it is unlikely that the bubbles flowing into the ink storage unit from the backward circulation path enter the outflow path.

In the printing apparatus, it is preferable that the inflow path has a diverged path which diverges from the outflow path and through which the ink, which returns to the ink storage unit from the outflow path without passing through the ink discharge head, flows.

In this case, it is unlikely that the bubbles flowing into the ink storage unit from the diverged path enter the outflow path.

In the printing apparatus, it is preferable that the inflow path has a supply flow path through which the ink, which is supplied to the ink storage unit from the ink container containing the ink, flows.

In this case, it is unlikely that the bubbles flowing into the ink storage unit from the supply flow path enter the outflow path.

BRIEF DESCRIPTION OF THE DRAWINGS

The invention will be described with reference to the accompanying drawings, wherein like numbers reference like elements.

FIG. 3A is a perspective view; FIG. 3B is a top view; and FIG. 3C is a sectional view.

FIG. 4A is a view illustrating a receptacle having a shape different from the receptacle illustrated in FIGS. 3A to 3C; FIG. 4B is a view illustrating a receptacle provided at a height position different in elevation from the receptacle illustrated in FIGS. 3A to 3C; FIG. 4C is a view illustrating a configuration in which one receptacle is provided with respect to a plurality of inflow paths; FIG. 4D is a view illustrating a receptacle having an opening provided on a side surface of the receptacle; FIG. 4E is a view illustrating a configuration in which a partition wall is provided instead of the receptacle.

DESCRIPTION OF EXEMPLARY EMBODIMENTS

Hereinafter, a printing apparatus 1 according to an embodiment of the invention will be described with reference to the accompanying drawings.

Figure 1:
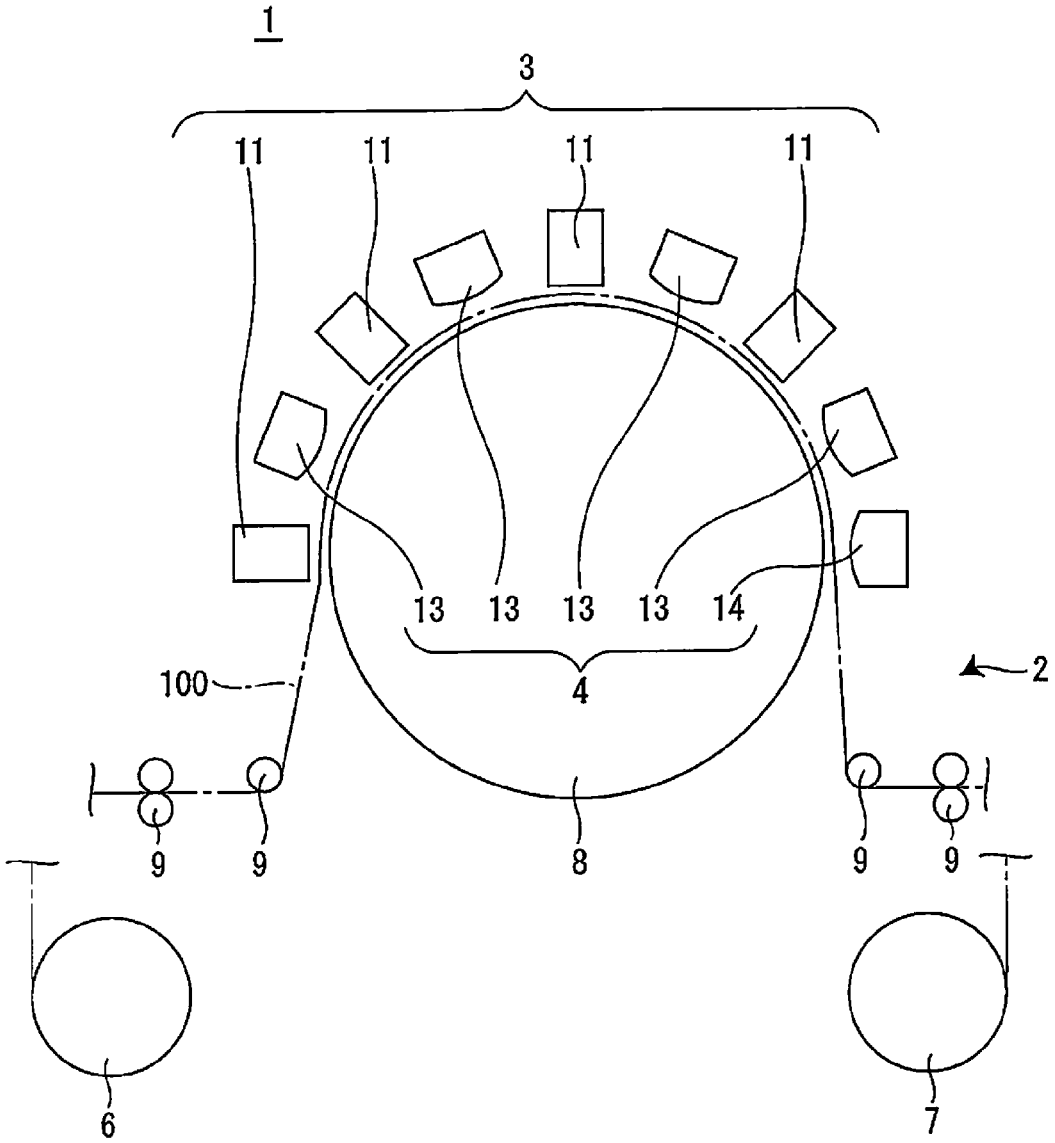
FIG. 1 is a view schematically illustrating a configuration of a printing apparatus according to an embodiment of the invention.

The entire configuration of the printing apparatus 1 will be described with reference to FIG. 1. The printing apparatus 1 performs printing to a set printing medium 100 by discharging ultraviolet curing ink (hereinafter, referred to as "UV ink"). The printing medium 100 is strip-shaped continuous paper. Further, there is no particular limitation on a material of the printing medium 100 and various media such as a paper medium or a film medium are used.

The printing apparatus 1 includes a feeding unit 2, an ink discharge section 3, and an irradiation unit 4. In addition, although not illustrated in FIG. 1, the printing apparatus 1 includes an ink supply unit 5 (refer to FIG. 2) which supplies the UV ink to the ink discharge section 3.

The feeding unit 2 feeds the printing medium 100 in a roll-to-roll method. The feeding unit 2 includes a supply reel 6, a winding reel 7, a rotating drum 8, and a plurality of rollers 9. The printing medium 100 supplied from the supply reel 6 is wound around the winding reel 7 through the rotating drum 8 and the plurality of rollers 9. The rotating drum 8 is a cylindrical drum which is rotatably supported by a support mechanism (not illustrated). When the printing medium 100 is fed along a circumferential surface of the rotating drum 8, the rotating drum 8 is driven to rotate due to frictional force between the circumferential surface and the printing medium 100. The rotating drum 8 functions as a platen with respect to the ink discharge section 3.

The ink discharge section 3 includes a plurality of head units 11. The plurality of head units 11 are arranged along the circumferential surface of the rotating drum 8. The plurality of head units 11 are in one-to-one correspondence to a plurality of types (for example, four colors of CMYK) UV ink. Each of the head units 11 includes a plurality of ink discharge heads 12 (refer to FIG. 2) which discharge UV ink in an ink jet method. The head unit 11 discharges UV ink to the printing medium 100 supported on the circumferential surface of the rotating drum 8. A color image is hereby formed on the printing medium 100.

The irradiation unit 4 includes a plurality of pre-curing irradiators 13 and a main-curing irradiator 14. The plurality of pre-curing irradiators 13 are arranged along the circumferential surface of the rotating drum 8 to be alternately positioned with the plurality of head units 11. The pre-curing irradiator 13 is provided on the downstream side on a feeding route of the printing medium 100 with respect to the corresponding head unit 11. The pre-curing irradiator 13 irradiates, with ultraviolet, the printing medium 100 to which the UV ink is discharged. The UV ink is hereby temporarily cured immediately after landing on the printing medium 100, and thus spreading of a dot or color mixing is suppressed. The main-curing irradiator 14 is provided further on the downstream side from the pre-curing irradiator 13 provided on the most downstream side on the feeding route. The main-curing irradiator 14 irradiates the printing medium 100, on which the discharge of the UV ink and the pre-curing are performed, with a cumulative intensity of ultraviolet light which is greater than that of the pre-curing irradiators 13. The UV ink landing on the printing medium 100 is hereby completely cured and is fixed on the printing medium 100.

In addition, for the pre-curing irradiator 13 and the main-curing irradiator 14, a light emitting diode (LED) lamp, a high-pressure mercury lamp, or the like, which performs irradiation with the ultraviolet, can be used.

Figure 2:
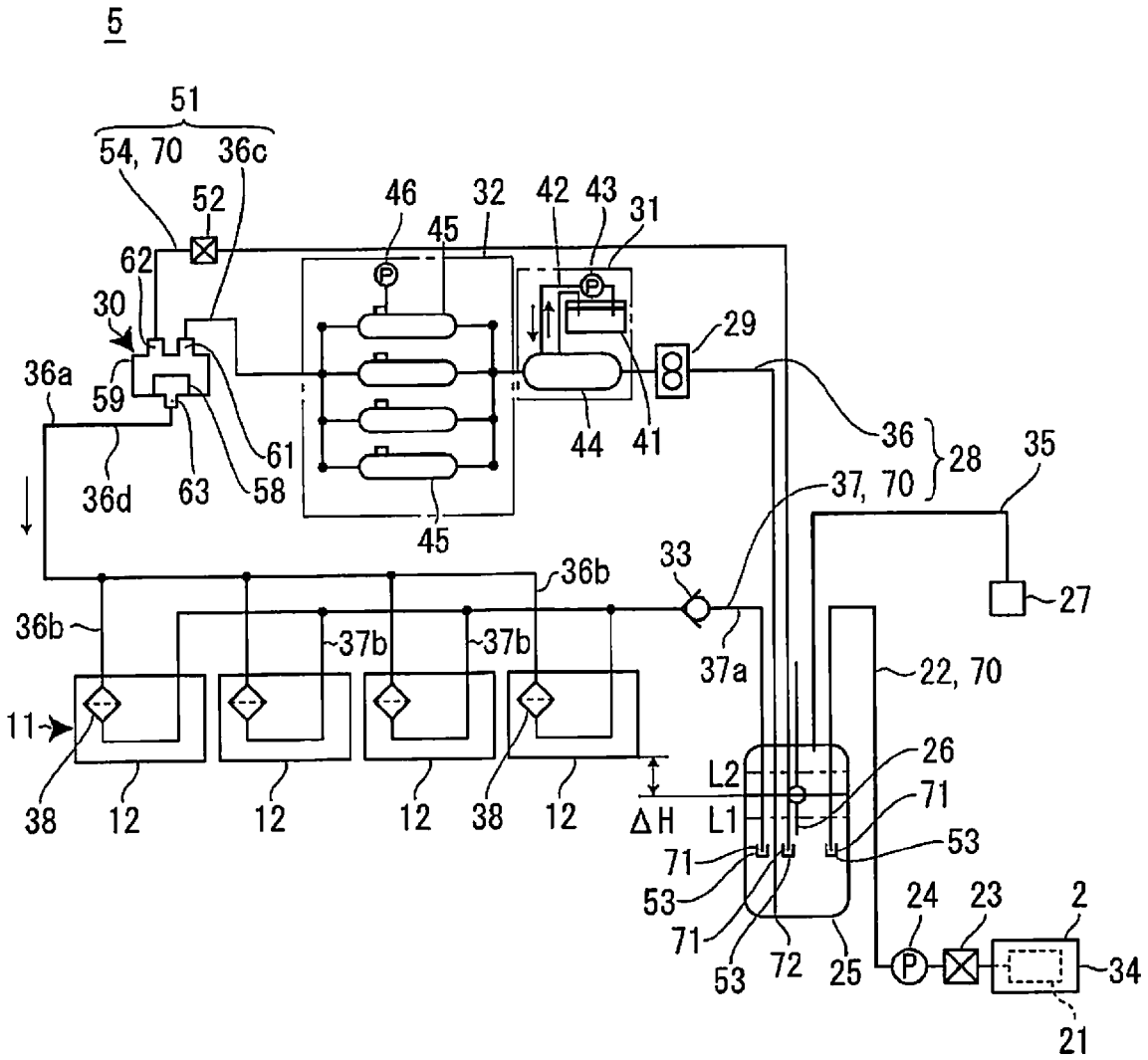
FIG. 2 is a piping system diagram illustrating an ink supply unit included in the printing apparatus illustrated in FIG. 1.

The ink supply unit 5 will be described with reference to FIG. 2. The ink supply unit 5 includes an ink cartridge 21, a supply flow path 22, a supply on-off valve 23, a supply pump 24, a sub-tank 25, a level sensor 26, a pressure regulating unit 27, a first circulation path 28, a heating unit 31, a de-airing unit 32, a forward-path filter 30, a check valve 33, a second circulation path 51, a second-circulation-path on-off valve 52, and a plurality of (for example, three) receptacles 53.

The UV ink is contained in the ink cartridge 21. The ink cartridge 21 is mounted on a holder 34. The upstream-side end of the supply flow path 22 is inserted into the ink cartridge 21 mounted on the holder 34 and the downstream-side end of the supply flow path 22 is inserted into the sub-tank 25. The supply on-off valve 23 and the supply pump 24 are provided in the supply flow path 22 in this order from the upstream side. The supply on-off valve 23 opens and closes the supply flow path 22. For example, as the supply on-off valve 23, a solenoid-controlled valve can be used. The supply pump 24 sends the UV ink contained in the ink cartridge 21 to the sub-tank 25 through the supply flow path 22.

The sub-tank 25 temporarily stores the UV ink sent from the ink cartridge 21. The sub-tank 25 is open-ended. The level sensor 26 detects whether or not the level of the UV ink in the sub-tank 25 is equal to or higher than a first level L1 and detects whether or not the level is higher than the first level L1 and is equal to or higher than a second level L2. When the level sensor 26 detects that the level of the UV ink in the sub-tank 25 is lower than the first level L1, the UV ink is supplied to the sub-tank 25 from the ink cartridge 21. When the level sensor 26 detects that the level of the UV ink in the sub-tank 25 is equal to or higher than the second level L2, the supply of the UV ink to the sub-tank 25 from the ink cartridge 21 is stopped. The level of the sub-tank 25 is hereby maintained between the first level L1 and the second level L2. Accordingly, a water head difference ΔH between a nozzle surface of the ink discharge head 12 and the liquid surface of the sub-tank 25 is maintained within a predetermined range. Back pressure of the UV ink inside the ink discharge head 12 is hereby maintained within a predetermined range (for example, from −400 Pa to 3000 Pa) and a good meniscus is formed in the nozzle of the ink discharge head 12.

The pressure regulating unit 27 supplies air into the sub-tank 25 or emits air in the sub-tank 25 through an air flow path 35, and thereby the inside of the sub-tank 25 is pressurized or depressurized. The pressure regulating unit 27 pressurizes the sub-tank 25 during initial filling of the first circulation path 28 with the UV ink, cleaning of the ink discharge head 12, or the like.

The first circulation path 28 is a flow path of the UV ink which returns from the sub-tank 25 through the ink discharge head 12 to the sub-tank 25. The first circulation path 28 includes a forward circulation path 36 and a backward circulation path 37.

The UV ink, which is supplied to the ink discharge head 12 from the sub-tank 25, flows through the forward circulation path 36. The forward circulation path 36 includes a forward-path-side inter-path 36*a*, and a plurality of first forward-path-side diverged paths 36*b* which diverge from the forward-path-side inter-path 36*a*. The upstream-side end of the forward-path-side inter-path 36*a* is inserted into the sub-tank 25. On the forward-path-side inter-path 36*a*, a circulation pump 29, the heating unit 31, the de-airing unit 32, and the forward-path filter 30 are provided in this order from the upstream side. Further, the forward-path-side inter-path 36*a* on the upstream side from the forward-path filter 30 is referred to as an upstream-side inter-path 36*c* and the forward-path-side inter-path 36*a* on the downstream side from the forward-path filter 30 is referred to as a downstream-side inter-path 36*d*. The first forward-path-side diverged path 36*b* is provided with respect to one ink discharge head 12. The downstream-side end of the first forward-path-side diverged path 36*b* is connected to the ink discharge head 12.

The UV ink, which returns to the sub-tank 25 from the ink discharge head 12, flows through the backward circulation path 37. In other words, the UV ink which is not discharged from the ink discharge head 12, of the UV ink supplied to the ink discharge head 12 through the forward circulation path 36 from the sub-tank 25, returns to the sub-tank 25 through the backward circulation path 37. The backward circulation path 37 includes a plurality of backward-path-side diverged paths 37*b* and a backward-path-side inter-path 37*a* to which the plurality of backward-path-side diverged paths 37*b* joins on the downstream side. The backward-path-side diverged path 37*b* is provided with respect to one ink discharge head 12. The upstream-side end of the backward-path-side diverged path 37*b* is connected to the ink discharge head 12. The downstream-side end of the backward-path-side inter-path 37*a* is inserted into the sub-tank 25. The check valve 33 is provided in the backward-path-side inter-path 37*a*.

The circulation pump 29 sends the UV ink stored in the sub-tank 25 toward the ink discharge head 12 side. Further, as the circulation pump 29, a gear pump can be appropriately used since the gear pump can suppress pulsation and has temporally small flow fluctuation.

The heating unit 31 heats the UV ink flowing through the first circulation path 28 to a predetermined temperature (for example, 35° C. to 40° C.). The predetermined temperature is a temperature at which the UV ink which is supplied to the ink discharge head 12 has a viscosity suitable for discharge from the ink discharge head 12. At the time of start-up of the printing apparatus 1, the UV ink having a temperature lower than the predetermined temperature is heated to the predetermined temperature by the heating unit 31, and then the printing apparatus 1 starts a printing operation.

The heating unit 31 includes a hot-water tank 41 having a heater and a thermometer, a hot-water circulating path 42, a hot-water pump 43, and a heat exchanger 44. The hot-water tank 41 stores hot water having a temperature adjusted within a predetermined temperature range. The hot-water circulating path 42 is a flow path through which hot water returns to the hot-water tank 41 through the heat exchanger 44 from the hot-water tank 41. The hot-water pump 43 circulates the hot water in the hot-water circulating path 42. The heat exchanger 44 performs heat exchange between the hot water flowing through the hot-water circulating path 42 and the UV ink flowing through the first circulation path 28.

The de-airing unit 32 expels air from the UV ink flowing through the first circulation path 28. The UV ink containing bubbles is hereby prevented from being supplied to the ink discharge head 12. The de-airing unit 32 includes a de-airing module 45 and a negative pressure pump 46. The de-airing module 45 includes a plurality of hollow fiber membranes. The negative pressure pump 46 depressurizes the outer side of the hollow fiber membrane. Air is hereby expelled from the UV ink flowing in the hollow fiber membrane.

The forward-path filter 30 filters the UV ink flowing through the forward circulation path 36, and thereby removes foreign matter in the UV ink. Foreign matter includes, for example, dust or bubbles mixed when the upstream-side end of the supply flow path 22 is inserted into the ink cartridge 21, a polymer of the UV ink due to frictional heat generated in the circulation pump 29 which is a gear pump, a polymer of the UV ink reacted with the hot water in the heat exchanger 44, fiber generated from the hollow fiber membrane of the de-airing module 45, or the like. Further, a head filter 38 that filters the UV ink is also provided on the inflow side of the ink discharge head 12; however, the forward-path filter 30 is provided in the forward circulation path 36, and thereby it is possible to sustain the head filter 38 which is difficult to replace.

The forward-path filter 30 includes a filter element 58 and a filter housing 59. The filter element 58 filters the UV ink. The filter element 58 is accommodated in the filter housing 59. The filter housing 59 includes a first joint 61 and a second joint 62 which are provided on the upstream side of the filter element 58 and a third joint 63 provided on the downstream side of the filter element 58. The first joint 61 is connected to the downstream-side end of the upstream-side inter-path 36*c*. The second joint 62 is connected to the upstream-side end of a second forward-path-side diverged path 54. The third joint 63 is connected to the upstream-side end of the downstream-side inter-path 36*d*. The first joint 61 and the second joint 62 are provided on the upper side from the filter element 58 and the third joint 63 is provided on the lower side from the filter element 58. From the filter housing 59, the forward circulation path 36 diverges into the second forward-path-side diverged path 54 which is connected to the second joint 62 and the downstream-side inter-path 36*d* which is connected to the third joint 63, between the heating unit 31 and the filter element 58.

The check valve 33 allows the UV ink to flow to the sub-tank 25 side in the backward circulation path 37 and blocks the UV ink from reversely flowing to the ink discharge head 12 side. The foreign matter which is contained in the UV ink reversely flowing through the backward circulation path 37 is prevented from entering the ink discharge head 12 by the check valve 33. Further, in order to replace a part of the ink discharge head 12, in a case where the backward circulation path 37 is detached from the sub-tank 25, or the like, the UV ink reversely flows to the ink discharge head 12 side in the backward circulation path 37.

The second circulation path 51 is a flow path through which the UV ink returns to the sub-tank 25 after passing through the circulation pump 29, the heating unit 31, and the de-airing unit 32 from the sub-tank 25 without passing through the filter element 58 and the ink discharge head 12. The second circulation path 51 includes the second forward-path-side diverged path 54 and the upstream-side inter-path 36*c* described above.

The second forward-path-side diverged path 54 diverges from the forward circulation path 36 in the filter housing 59, in other words, between the heating unit 31 and the filter element 58. As will be described below, the upstream-side end of the second forward-path-side diverged path 54 is connected to the second joint 62 of the forward-path filter 30 and the downstream-side end of the second forward-path-side diverged path 54 is inserted into the sub-tank 25. The second-circulation-path on-off valve 52 is provided in the second forward-path-side diverged path 54.

The second-circulation-path on-off valve 52 opens and closes the second forward-path-side diverged path 54. That is, the second-circulation-path on-off valve 52 closes the second forward-path-side diverged path 54 and achieves a first state in which the UV ink is blocked from flowing to the second forward-path-side diverged path 54 from the upstream-side inter-path 36*c* and the second-circulation-path on-off valve opens the second forward-path-side diverged path 54, and achieves a second state in which the UV ink is allowed to flow to the second forward-path-side diverged path 54 from the upstream-side inter-path 36*c*. In a state in which the second-circulation-path on-off valve 52 enters into the first state, the UV ink circulates in the first circulation path 28 when the circulation pump 29 operates. In comparison, in a state in which the second-circulation-path on-off valve 52 enters into the second state, a part of the UV ink sent to the forward-path filter 30 from the sub-tank 25 passes through the filter element 58 and flows to the downstream-side inter-path 36*d*, but most thereof flows to the second forward-path-side diverged path 54 when the circulation pump 29 operates. Therefore the UV ink mainly circulates in the second circulation path 51. The second-circulation-path on-off valve 52 enters into the second state during an ink heating process at the time of the start-up. Otherwise, the second-circulation-path on-off valve 52 enters into the first state. For example, as the second-circulation-path on-off valve 52, a solenoid-controlled valve can be used.

The second circulation path 51 has a flow path length shorter than the flow path length of the first circulation path 28. Therefore, heat discharge when the UV ink circulates in the second circulation path 51 is less than heat discharge when the UV ink circulates in the first circulation path 28. In addition, the filter element 58 and the head filter 38 are not provided in the second circulation path 51. Therefore, pressure loss of the UV ink in the second forward-path-side diverged path 54 is less than pressure loss of the UV ink in the first circulation path 28 in which the filter element 58 and the head filter 38 are provided. A flow rate of the UV ink in the heating unit 31, which is obtained when the UV ink mainly circulates in the second circulation path 51, is hereby greater than a flow rate of the UV ink in the heating unit 31 when the UV ink circulates in the first circulation path 28. Therefore, when the UV ink is caused to mainly circulate in the second circulation path 51 and the UV ink is heated by the heating unit 31, the UV ink is caused to circulate in the first circulation path 28 and heating efficiency of the UV ink is improved, compared to a case where the UV ink is heated by the heating unit 31. Accordingly, when the UV ink is heated by the heating unit 31 at the time of the start-up of the printing apparatus 1, the second-circulation-path on-off valve 52 enters into the second state, the UV ink is caused to mainly circulate in the second circulation path 51, and thereby it is possible to heat the UV ink to the predetermined temperature for a short period of time.

In addition, as described above, the second joint 62 of the forward-path filter 30, that is, the upstream-side end of the second forward-path-side diverged path 54 is provided above the filter element 58. Therefore, when the UV ink circulates in the second circulation path 51, the bubbles accumulated in the filter element 58 enter the second forward-path-side diverged path 54 through the second joint 62 due to the buoyancy of the bubbles themselves and are emitted to the sub-tank 25. Therefore, before the UV ink is caused to circulate in the first circulation path 28, the UV ink is caused to circulate in the second circulation path 51, and thereby it is possible for the UV ink to be caused to circulate in the first circulation path 28 in a state in which the bubbles are present to the smallest extent in the filter element 58 in which the bubbles are likely to be accumulated. The carrying of the bubbles into the ink discharge head 12 side is hereby suppressed.

As described above, the UV ink flows into the sub-tank 25 from each of the supply flow path 22, the backward circulation path 37, and the second forward-path-side diverged path 54. The supply flow path 22, the backward circulation path 37, and the second forward-path-side diverged path 54, are referred to as "inflow paths 70", respectively. In addition, an opening on the downstream side of each of the inflow paths 70 is referred to as an "inlet 71". Meanwhile, the UV ink in the sub-tank 25 flows out from the forward circulation path 36. An opening on the upstream side of the forward circulation path 36 is referred to as an "outlet 72".

The forward circulation path 36 extends to the vicinity of the bottom of the sub-tank 25 such that substantially the entire amount of the UV ink in the sub-tank 25 can be removed as liquid waste through the forward circulation path 36. That is, the outlet 72 of the forward circulation path 36 is positioned below the inlets 71 of the supply flow path 22, the backward circulation path 37, and the second forward-path-side diverged path 54. It is hereby unlikely that the bubbles flowing into the sub-tank 25 from the inlets 71 enter the outlet 72. However, in a case where gaps between the inlets 71 of the three inflow paths 70 and the outlet 72 are close, currents of the UV ink are generated from the inlets 71 to the outlet 72. Therefore, there is a concern that the bubbles flowing into the sub-tank 25 from the inlets 71 will ride the current to be carried to the outlet 72, and will enter the forward circulation path 36. When the bubbles entering the forward circulation path 36 reaches the ink discharge head 12, this results in defective discharge of the ink discharge head 12 and the absence of dots is exhibited on the printed image. Therefore, in the printing apparatus 1 of the embodiment, the receptacles 53 are provided for three inflow paths 70, respectively. That is, three receptacles 53 are provided in one-to-one correspondence to the three inflow paths 70.

The receptacles 53 provided in the backward circulation path 37 will be described with reference to FIGS. 3A to 3C. Further, the receptacle 53 provided in the backward circulation path 37 is representatively described; however, the following description similarly corresponds to the receptacle 53 provided for the supply flow path 22 and the receptacle 53 provided for the second forward-path-side diverged path 54.

Figure 3A:
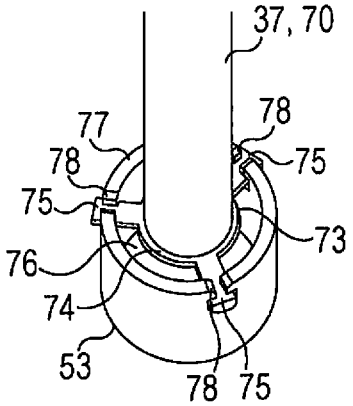
FIGS. 3A to 3C are views illustrating a receptacle included in the ink supply unit illustrated in FIG. 2.
Figure 3B:
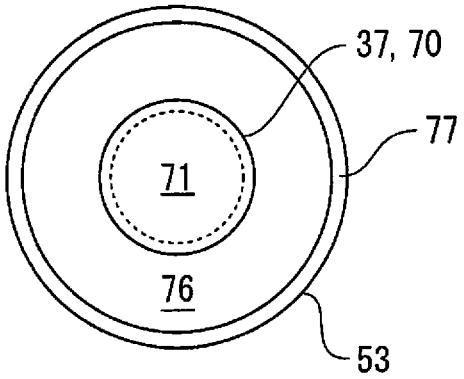
Figure 3C:
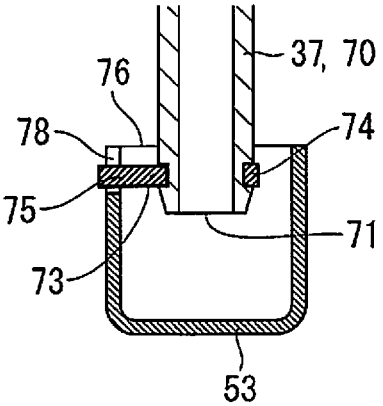

As illustrated in FIGS. 3A and 3C, the receptacle 53 is attached to the backward circulation path 37 through an attachment member 73. The attachment member 73 includes a fitting portion 74 and three engagement portions 75. The fitting portion 74 is formed to have an annular shape. The lower end portion of the backward circulation path 37 formed to be circular in a sectional view fits to the fitting portion 74. The three engagement portions 75 are provided with respect to the fitting portion 74 substantially at an equal interval in a circumferential direction and protrude in the radial direction of the fitting portion 74. The distal end of the engagement portion 75 engages with a notch 78 to be described below.

As illustrated in FIGS. 3A to 3C, the receptacle 53 is formed to be substantially cylindrical with the bottom. In other words, the receptacle 53 has an opening 76 opened upward. The three notches 78 are provided substantially at an equal interval on an opening edge portion 77 of the opening 76. The distal end of the engagement portion 75 engages with the notch 78. The receptacle 53 is provided such that an opening edge portion 77 of an opening 76 surrounds the inlet 71 of the backward circulation path 37 in a top view (refer to FIG. 3B). The opening 76 of the receptacle 53 is positioned below the inlet 71 of the inflow path 70 (refer to FIG. 3C).

As above, according to the printing apparatus 1 of the present embodiment, the receptacles 53 are provided for the inflow paths 70, and the bubbles are contained in the UV ink flowing into the sub-tank 25 from the inflow paths 70. Although the bubbles move from the inlet 71 toward the outlet 72, the movement is blocked at a position along the path by the receptacle 53, and the bubbles rise toward the liquid surface due to their buoyancy. Therefore, the bubbles are prevented from entering the forward circulation path 36 from the outlet 72 provided below the inlet 71. As a result, it is unlikely that the bubbles reach the ink discharge head 12, and thus it is possible to reduce defective discharge of the ink discharge head 12 due to the bubbles. Accordingly, in the printing apparatus 1, it is possible to prevent the occurrence of the absence of dots on the printed image.

According to the printing apparatus 1 of the embodiment, since the receptacle 53 is provided with respect to each inflow paths 70, even in a case the outlet 72 of the forward circulation path 36 is positioned between the respective inlets 71 of the plurality of inflow paths 70, the bubbles flowing into the sub-tank 25 from the inflow paths 70, are prevented from entering the forward circulation path 36.

Further, the ink cartridge 21 is an example of an "ink container". The sub-tank 25 is an example of an "ink storage unit". The forward circulation path 36 is an example of an "outflow path".

The invention is not limited to the embodiment described above, and it is needless to say that various configurations within a scope without departing from the gist of the invention can be employed. For example, the embodiment can be modified in accordance with the following aspects.

A modification example of the embodiment will be described with reference to FIGS. 4A to 4E.

Figure 4A:
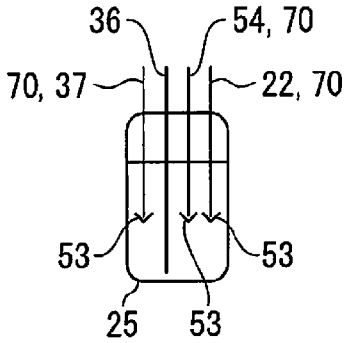
FIGS. 4A to 4E are views illustrating a modification example of the embodiment.

There is no particular limitation on the shape of the receptacle 53 and, as illustrated in FIG. 4A, the top surface is opened and the receptacle may have a substantially inverted conical shape.

Figure 4B:
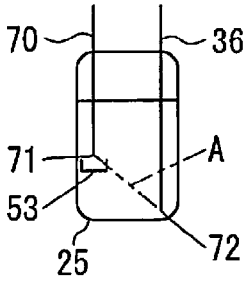

The opening 76 of the receptacle 53 does not need to be positioned above the inlet 71 and, as illustrated in FIG. 4B, the opening may be positioned above a virtual line A connecting the inlet 71 and the outlet 72.

Figure 4C:
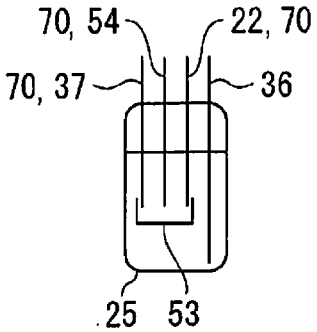

As illustrated in FIG. 4C, the printing apparatus 1 includes one receptacle 53 and the receptacle 53 is provided with respect to the plurality of inflow paths 70, for example, the supply flow path 22, the backward circulation path 37, and the second forward-path-side diverged path 54. Even when a plurality of receptacles 53 are not provided in one-to-one correspondence to the plurality of inflow paths 70, the bubbles flowing into the sub-tank 25 from the inflow paths 70 are prevented from entering the forward circulation path 36 is hereby suppressed. Therefore, according to the modification example, it is possible to reduce the number of receptacle 53, compared to the case wherein the plurality of receptacles 53 are provided in one-to-one correspondence to the plurality of inflow paths 70.

Figure 4D:
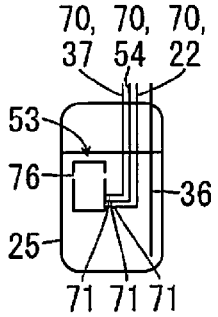

As illustrated in FIG. 4D, the opening 76 does not need to be opened upward and the opening 76 may be formed on the side surface of the receptacle 53. In addition, the opening edge portion 77 of the opening 76 does not need to be provided to surround the inlet 71, and the inlet 71 of the inflow path 70 may be connected to a connection port opened on the side surface of the receptacle 53 below the opening 76 formed in the side surface of the receptacle 53.

Figure 4E:
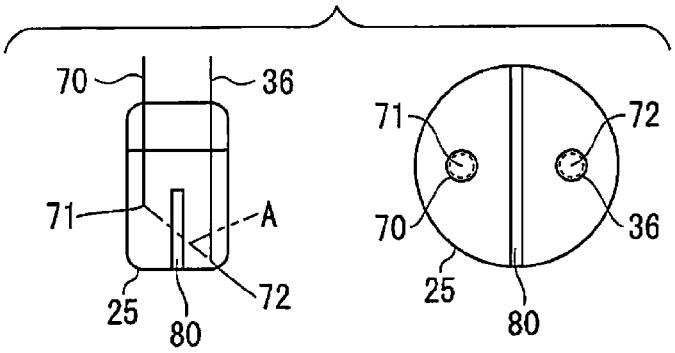

As illustrated in FIG. 4E, the printing apparatus 1 may include a partition wall 80 instead of the receptacle 53. The partition wall 80 is provided between the inlet 71 and the outlet 72. The partition wall 80 is attached to the bottom of the sub-tank 25. Further, in a case where a stirring blade is provided on the bottom of the sub-tank 25, the partition wall 80, for example, may be attached to the inner circumferential surface of the sub-tank 25. Similar to the receptacle 53 described above, the upper end portion of the partition wall 80 is disposed above the inlet 71; however, the upper end portion may be positioned above the virtual line A connecting the inlet 71 and the outlet 72. Similar to the receptacle 53, the partition wall 80 configured as above causes the bubbles flowing into the sub-tank 25 from the inflow paths 70 to be prevented from entering the forward circulation path 36.

The receptacle 53 or the partition wall 80 described above functions as a bubble blocking unit that blocks bubbles contained in the UV ink flowing to the sub-tank 25 from the inflow paths 70 from entering the forward circulation path 36; however, the state of the bubble blocking unit is not limited thereto.

The ink used in the printing apparatus 1 is not limited to the UV ink and, for example, water-based ink, oil-based ink, solvent ink or sublimation ink may be used.

The entire disclosure of Japanese Patent Application No. 2015-068977, filed Mar. 30, 2015 is expressly incorporated by reference herein.

What is claimed is:

1. A printing apparatus comprising:

an ink discharge head that discharges ink;

an ink tank that stores the ink;

an outflow path through which the ink flowing out from the ink tank to the ink discharge head flows;

an inflow path through which the ink flowing into the ink tank flows; and a receptacle disposed inside of the ink tank and having an opening which opens upward and that is provided such that an opening edge portion of the opening surrounds an inlet of the inflow path, in a top view, the receptacle being configured to prevent bubbles contained in the ink flowing into the ink tank through the inflow path from entering the outflow path, an outlet of the outflow path being positioned below the inlet, and the opening of the receptacle being positioned above a virtual line connecting the inlet of the inflow path and the outlet of the outflow path.

2. The printing apparatus according to claim 1, wherein the opening of the receptacle is positioned above the inlet.

3. The printing apparatus according to claim 1, further comprising:

a plurality of the inflow paths, wherein the single receptacle is provided with respect to the plurality of inflow paths.

4. The printing apparatus according to claim 1, further comprising:

a plurality of the inflow paths; and a plurality of the receptacles, wherein the plurality of receptacles are provided in one-to-one correspondence to the plurality of inflow paths.

* * * * *